313-414 SR
2/5/85 OR 4,498,026

United States Patent [19]

Yamauchi et al.

[11] Patent Number: 4,498,026

[45] Date of Patent: Feb. 5, 1985

[54] ELECTRON GUN FOR COLOR PICTURE TUBE

[75] Inventors: Masaaki Yamauchi, Tougane; Minoru Yabe, Mobara; Shoji Shirai, Koganei; Hidemasa Komoro, Chiba; Kenichi Matsuda, Mobara, all of Japan

[73] Assignee: Hitachi, Ltd., Tokyo, Japan

[21] Appl. No.: 462,450

[22] Filed: Jan. 31, 1983

[30] Foreign Application Priority Data

Feb. 3, 1982 [JP] Japan ..... 57-14991

[51] Int. Cl.[3] ..... H01J 29/50; H01J 29/56

[52] U.S. Cl. ..... 313/414

[58] Field of Search ..... 313/412, 414

[56] References Cited

U.S. PATENT DOCUMENTS 4,374,342 2/1983 Say ..... 313/414

FOREIGN PATENT DOCUMENTS 82548 7/1981 Japan ..... 313/414

56-51648 12/1981 Japan .

*Primary Examiner*—Palmer Demeo

*Attorney, Agent, or Firm*—Charles E. Pfund

[57] ABSTRACT

An electron gun for a color picture tube comprises opposing cup-shaped electrodes each having a plurality of openings laterally aligned in a row, the electrodes being combined such that the openings face each other to form electron lenses. The openings are formed in flat bottom walls of said electrodes, a width of a bridge portion between adjacent openings is 0.5 to 1.5 times a thickness of the bottom wall of each electrode, and corrective plate electrodes are arranged to oppose bridge portions with a predetermined distance therefrom. The electrodes are combined such that spherical aberration of said electron lenses as a whole can be reduced when one of the electrodes is applied with a voltage which is higher than that applied to the other.

3 Claims, 16 Drawing Figures

ELECTRON GUN FOR COLOR PICTURE TUBE

BACKGROUND OF THE INVENTION

The present invention relates to an in-line electron gun for a color picture tube and, more particularly, to a main lens structure suitably adapted for improving the focusing characteristics.

In the in-line electron gun, the main lens electrodes for the respective electron beams must be aligned laterally in a row, and the diameter of each main lens thus becomes smaller than that for a delta electron gun. The diameter of the neck cannot be increased beyond a predetermined value due to limitations imposed by deflecting power, convergence of three electron beams and so on. Furthermore, the gap between the outer diameter of the electron gun and the inner diameter of the neck must be over, for example, 1 mm so as to prevent deterioration of the glass inner wall of the neck due to irradiation with electrons. Accordingly, the diameter of the main lens cannot be increased as desired.

FIG. 1 is a plan view of an electrode for forming the main lenses of a conventional electron gun as disclosed in Japanese utility model publication No. 51648/81, and FIG. 2 is a partially broken front view thereof. Referring to FIGS. 1 and 2, a cup-shaped electrode 1 has three cylindrical portions 2 for passing three electron beams therethrough aligned laterally in a row along the x—x direction. Two such electrodes 1 are combined such that the respective cylindrical portions 2 face each other at surfaces 3 so as to form three main lenses for respective three electron beams. In such an electrode, since a bridge portion 4 between each pair of adjacent cylindrical portions 2 does not play an essentially important role in forming the electron lens, it is preferable that the bridge portion have as small a size as possible. However, reduction in the size of the bridge portion 4 is limited by tolerance of a pressing die. For this reason, the opening or inner diameter of each cylindrical portion 2 becomes about 80% of a pitch p between adjacent cylindrical portions 2. If the electrode is to be housed within a neck having an outer diameter of, for example, 29 mm, the inner diameter of each cylindrical portion 2 becomes 5.5 mm for a pitch p of 6.6 mm. For information, each cylindrical portion of a delta electron gun will have an inner diameter of 6.35 mm under the same conditions.

When the opening of each cylindrical portion of the electrode is small, the focusing performance of the main lenses is degraded, resulting in poor resolution.

SUMMARY OF THE INVENTION

It is, therefore, an object of the present invention to provide a simplified electron gun for a color picture tube which can increase the effective lens diameter for a given neck diameter.

In order to achieve this object, there is provided according to the present invention an electron gun for a color picture tube wherein a plurality of openings are formed laterally in the bottom of a cup-shaped electrode such that a bridge portion between adjacent openings has a width of 0.5 to 1.5 times the thickness of the bottom, and a corrective plate electrode is arranged to oppose the bridge portion. When a pair of the cup-shaped and corrective plate electrodes are opposed to another pair and different voltages are applied to them, the potential distribution becomes asymmetrical about the central axis of each opening of the electrode, but by virture of the cup-shaped and corrective plate electrodes in combination, an electron lens as a whole acts to eliminate astigmatism of the electron beam spot.

DETAILED DESCRIPTION OF THE PREFERRED EMBODIMENTS

A preferred embodiment of the present invention will now be described with reference to the accompanying drawings.

Figure 3:
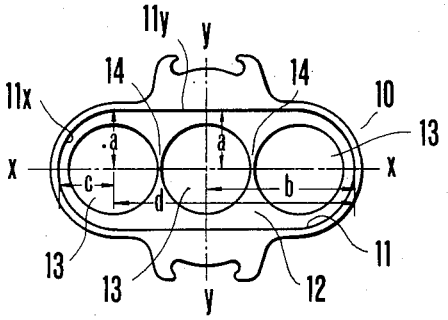
FIG. 3 is a plan view of an electrode of an electron gun according to the present invention at an interim stage of the manufacturing process thereof.
Figure 4:
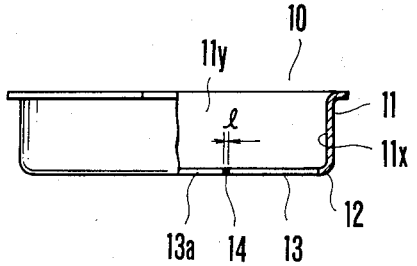
FIG. 4 is a partially broken front view of the electrode gun shown in FIG. 3.

FIG. 3 is a plan view of an electrode of an electron gun for a color picture tube according to the present invention in the middle of the manufacturing process, and FIG. 4 is a partially broken front view thereof. Referring to FIGS. 3 and 4, an electrode 10 of cup-shape has a peripheral wall 11 and a flat bottom wall 12. Three openings 13 are formed in a row along the x—x direction by pressing in the bottom wall 12. In order to obtain a maximum diameter of these openings 13 without impairing the rigidity of mechanical structure of the electrode, length of a bridge portion 14 between adjacent openings 13 is determined to be 0.5 to 1.5 times the thickness of the bottom wall 12. If a neck has an outer diameter of, for example, 29 mm, the respective openings 13 formed with a pitch of 6.6 mm between adjacent ones, may have a large diameter which measures 6.4 to 6.5 mm. The peripheral wall 11 has inner surfaces 11*y* which are spaced apart from each other in the y—y direction, and inner surfaces 11*x* which are similarly spaced apart from each other in the x—x direction. However, when two such electrodes 10 are simply combined such that the openings 13 oppose each other to form main lenses, the same effects as those obtained with the conventional cylindrical lenses may not be obtained.

This is attributed to the following reasons. In the electrode shown in FIGS. 3 and 4, there is no cylindrical portion projecting inward from the bottom wall of the cup-shaped electrode, and while the center of the central opening 13 is distant from either inner wall 11*y* by a and from either inner wall 11*x* by b, the center of each side opening 13 is distant from either inner surface 11*y* by a and from the opposing inner surfaces 11*x* by c and d, the distances a b, c and d being significantly different from each other. For this reason, the peripheral wall has a different effect on the respective openings so that the potential distribution of each opening may not become symmetrical with respect to its central axis and desired electron lens characteristics may not be obtained. In view of this, according to the present invention, corrective plate electrodes are incorporated at predetermined positions to correct the asymmetrical electric potential distribution.

Figure 5:
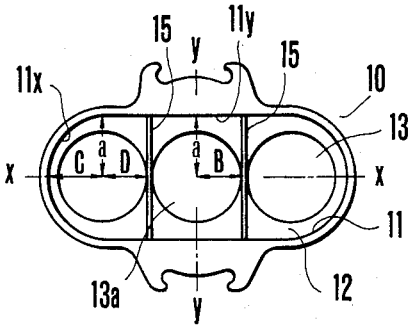
FIG. 5 is a plan view of an electrode of an electron gun according to an embodiment of the present invention.
Figure 6:
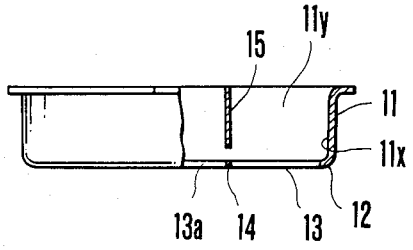
FIG. 6 is a partially broken front view of the electrode shown in FIG. 5.
Figure 7:
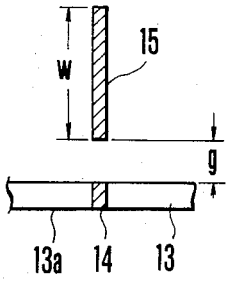
FIG. 7 is an enlarged view of the main part of the electrode shown in FIG. 6.

FIG. 5 is a plan view of an embodiment of an electrode of an electron gun for a color picture tube according to the present invention, FIG. 6 is a partial broken view thereof, and FIG. 7 is an enlarged front view of the main part thereof. Referring to FIGS. 5 to 7, a corrective electrode 15 is arranged immediately above each bridge portion 14 at a distance g therefrom to extend along the y—y direction. Each corrective plate electrode 15 is fixed to the inner surfaces 11*y*. The thickness of the auxiliary electrode 15 is selected to be equal to or smaller than the width l of the bridge portion 14. The width of the corrective electrode 15 is indicated by w.

With this arrangement, the distances d and b shown in FIG. 3 are modified to correspond to distances D and B as shown in FIG. 5. Therefore, the distance between the center of the central opening and the peripheral wall can approach the distance between the center of the side opening and the peripheral wall, thus eliminating the problem of different distance for different lenses. However, the main lenses thus obtained are asymmetrical and are subject to the influence of astigmatism. Therefore, these lenses cannot form electron beams having circular spots on a phosphor screen. In particular, in respect of the central opening 13*a*, a>B. This implies that, in the central opening 13*a*, the distance 2B between the corrective electrodes 15 is smaller than the distance 2*a* between the inner surfaces 11*y*. Thus, when such an electrode is used as a third grid electrode, the electron beam produced will have a vertically elongated elliptical spot on a phosphor screen.

However, the spot of the electron beam on a phosphor screen may be made substantially circular by suitably setting the distance g between the corrective plate electrode 15 and the bridge portion 14 of one electrode in accordance with the characteristics of the other opposing electrode to be combined therewith.

Figure 8:
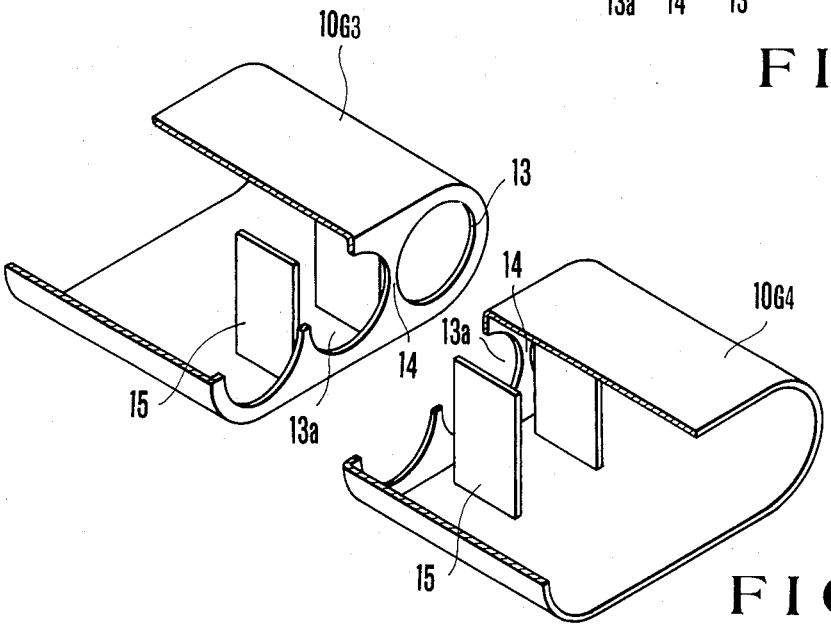
FIG. 8 is a partially broken perspective view of an embodiment of the present invention.
Figure 9:
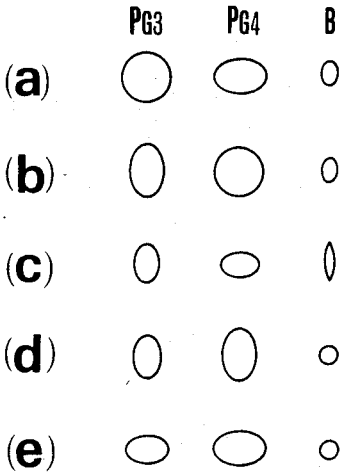
FIG. 9 shows the relationship between combinations of potential distribution in the openings and the shape of the beam spot.

FIG. 8 is a partially broken perspective view of a second embodiment directed to such an arrangement. In FIG. 8, the same reference numerals as in FIGS. 5 to 7 denote the same parts. Referring to FIG. 8, reference symbol $\mathbf{10}_{G3}$ denotes a third grid electrode while reference symbol $\mathbf{10}_{G4}$ denotes a fourth grid electrode. The electron beams from the electron gun are incident on the third grid electrode $\mathbf{10}_{G3}$ and are focused on a phosphor screen through the fourth grid electrode $\mathbf{10}_{G4}$. Although the third and fourth grid electrodes $\mathbf{10}_{G3}$ and $\mathbf{10}_{G4}$ are spaced apart from each other in the figure, they are actually sufficiently close to each other so that each pair of opposing openings 13 or 13*a* forms an electron lens. A voltage higher than that applied to the third grid electrode $\mathbf{10}_{G3}$ is applied to the fourth grid electrode $\mathbf{10}_{G4}$. FIG. 9 shows the results obtained by experiment and computer simulation of electron trajectories on the relationship between a shape ($P_{G3}$) of an equipotential line within the opening 13 of the third grid electrode $\mathbf{10}_{G3}$, a shape ($P_{G4}$) of an equipotential line within the opening 13 of the fourth grid electrode $\mathbf{10}_{G4}$, and a shape B of a spot of an electron beam formed on a phosphor screen after being focused by the electron lens. The equipotential lines are represented in a simplified form in the figure. The third grid electrode $\mathbf{10}_{G3}$ on which the electron beams are incident at first affects the shape of the beam spot more than the fourth grid electrode $\mathbf{10}_{G4}$. The third grid electrode $\mathbf{10}_{G3}$ serves to make the shape of the beam spot the same as that of its equipotential line, while the fourth grid electrode $\mathbf{10}_{G4}$ serves to make the shape of the beam spot the opposite to that of its equipotential line.

FIG. 9 illustrates in section (a) a case wherein the shape $P_{G3}$ of the equipotential line is circular, while the shape $P_{G4}$ of the equipotential line is a laterally elongated ellipse. In this case, the shape B of the beam spot is a vertically elongated ellipse due to the influence of the shape $P_{G4}$ of the equipotential line. The size of the shapes $P_{G3}$ and $P_{G4}$ varies with the strength of the electron lens as illustrated at sections (a) through (e) in FIG. 9. Illustrated at section (b) in FIG. 9 is a case wherein the shape $P_{G3}$ is a vertically elongated ellipse, while the shape $P_{G4}$ is circular, and the shape B of the beam spot is vertically elongated due to the influence of the shape $P_{G3}$. Since, in this case, the influence of the shape $P_{G3}$ is greater than that of the shape $P_{G4}$, the shape B at section (b) in FIG. 9 becomes more elongated than that at section (a) even if the $P_{G4}$ at section (a) and the $P_{G3}$ at section (b) have the same intensity of field of the electron lenses. Illustrated at section (c) in FIG. 9 is a case wherein the shape $P_{G3}$ is a vertically elongated ellipse, while the shape $P_{G4}$ is a horizontally elongated ellipse. In the case, the shape B of the beam spot becomes a vertically elongated thin ellipse due to the combined effects of both shapes $P_{G3}$ and $P_{G4}$.

Illustrated at section (d) in FIG. 9 is a case wherein the shape $P_{G3}$ is a vertically elongated ellipse, while the shape $P_{G4}$ is similarly a vertically elongated ellipse but of slightly larger size (a stronger field of the electron lens). In this case, the shape B of the beam spot becomes circular due to the influence of the shapes of both equipotential lines. Illustrated at section (e) in FIG. 9 is a case wherein the shape $P_{G3}$ is a horizontally elongated ellipse, while the shape $P_{G4}$ is similarly a horizontally elongated ellipse but of slightly larger size. In this case, the shape B of the beam spot becomes circular as in the case of section (d).

According to an electron gun of the present invention, combinations of the shapes of equipotential lines of main lenses as shown at sections (d) and (e) in FIG. 9 may be easily realized by suitably setting the distance g between each corrective electrode and each bridge portion for the third grid electrode $\mathbf{10}_{G3}$ and the fourth grid electrode $\mathbf{10}_{G4}$. In this manner, main lenses of large diameter can be obtained, while assuring a circular shape of the beam spots. This will be described in more detail hereinbelow.

Figure 10A:
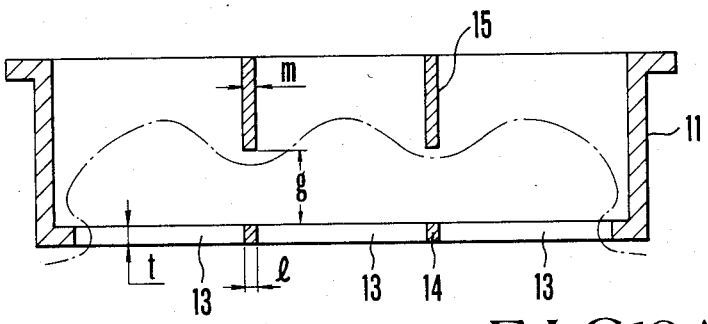
FIGS. 10A to 10E are diagrammatic representations for explaining the effects of the present invention.

FIG. 10A shows the structure of an electrode according to the present invention. The width l of a bridge portion between adjacent openings holds a relation $0.5t \leqq l \leqq 1.5t$ where t is the thickness of the bottom wall of a cup-shaped electrode 10. If a thickness m of a corrective electrode 15 is set such that $m \leqq l$, the corrective plate electrode 15 positioned in accordance with the distance g has a full influence upon the peripheral edge of opening 13. Therefore, more equipotential lines cross bridge portions 14 and extend over three adjacent openings 13 inside the cup-shaped electrode 11, curving gradually or smoothly as indicated by the broken line in FIG. 10A. Thus, the characteristics as described with reference to FIG. 9 are easily obtained by suitably setting the distance g.

Figure 10B:
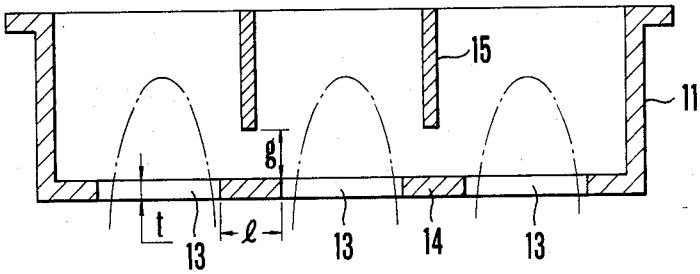

When the width l holds a relation $1.5t < l$ as shown in FIG. 10B, the peripheral edge of each opening 13 and an end surface of the corrective plate electrode 15 are shielded from each other by a corresponding bridge portion 14 and it reduces the number of equi-potential lines crossing bridge portions 14 and extending over the three adjacent openings 13, and the function of the corrective plate electrodes 15 becomes complex. It then becomes difficult to optimize the corrective plate electrodes 15 and its arrangement so as to obtain optimum performance.

Figure 1:
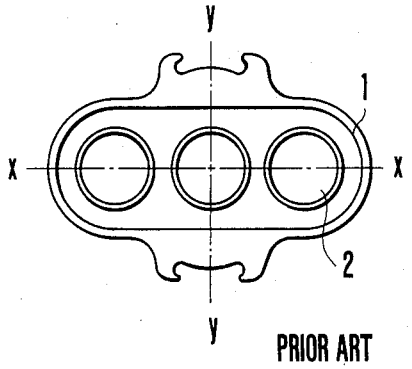
PRIOR ART FIG.1
FIG. 1 is a plan view of a conventional electrode.
Figure 2:
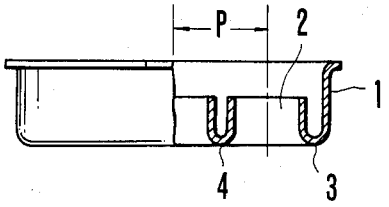
PRIOR ART FIG.2
FIG. 2 is a partially broken front view of the conventional electrode shown in FIG. 1.
Figure 10C:
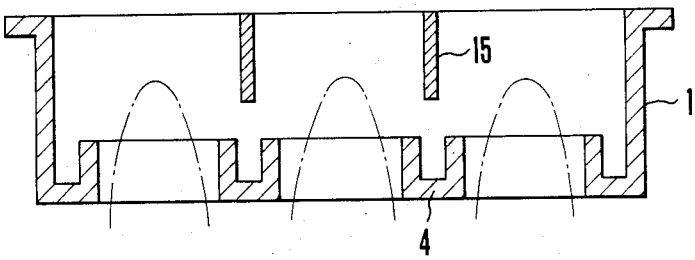
FIG.10C PRIOR ART

FIG. 10C shows a combination of the conventional electrode shown in FIG. 1 with the corrective plate electrodes 15 according to the present invention. Since cylindrical portions project inward from the surface of the electrode, satisfactory results may not be obtained with the simple plate-shaped corrective electrodes 15 according to the present invention.

As may be seen from a comparison of FIG. 10A with FIGS. 10B and 10C, the substantial diameter of the electron lens is far greater in FIG. 10A than in FIGS. 10B and 10C, reduces spherical aberration and provides satisfactory results in this respect.

Figure 10E:
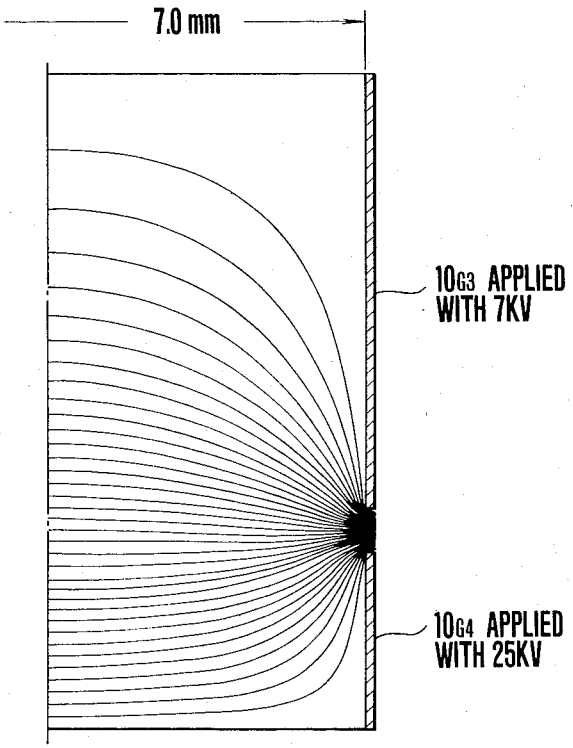
Figure 10D:
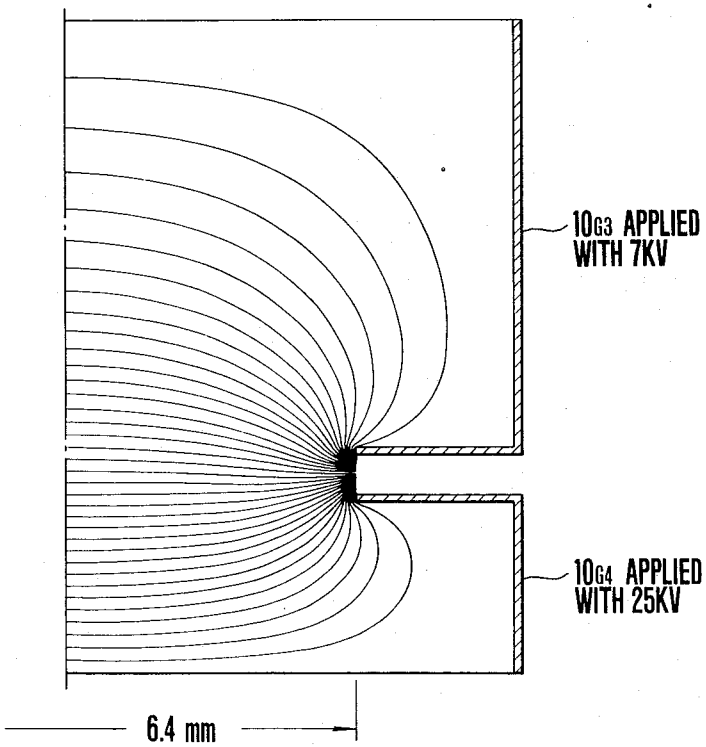

Reference should be made to FIGS. 10D and 10E for better understanding of the effects brought about by the present invention.

Equi-potential line distribution within the electrostatic lens of the present invention is plotted on the basis of computer simulation, as shown in FIG. 10D. With the prior art cylinder lens wherein cylinder ends oppose, equi-potential line distribution is plotted as shown in FIG. 10E through a similar computer simulation.

With the prior art cyliner lens, an experiment was conducted to obtain effective equi-potential line distribution of the type shown in FIG. 10D within an effective region through which the electron beam passes and, it was proven that the diameter in the prior art cylinder lens must be 7.0 mm in order to obtain the effective equi-potential line distribution comparable to that obtained with the aperture diameter of 6.4 mm of the lens structure according to the invention. In other words, the lens of the type shown in FIG. 10D advantageously attains the effect in which the aperture diameter is substantially increased.

It is now assumed that the correction plate electrode 15 in the third grid electrode $\mathbf{10}_{G3}$ is spaced apart from the corresponding bridge by g3 and has a width of w3 while the corresponding distance and width of the corrective plate electrode 15 in the fourth grid electrode being g4 and w4, respectively.

Figure 11:
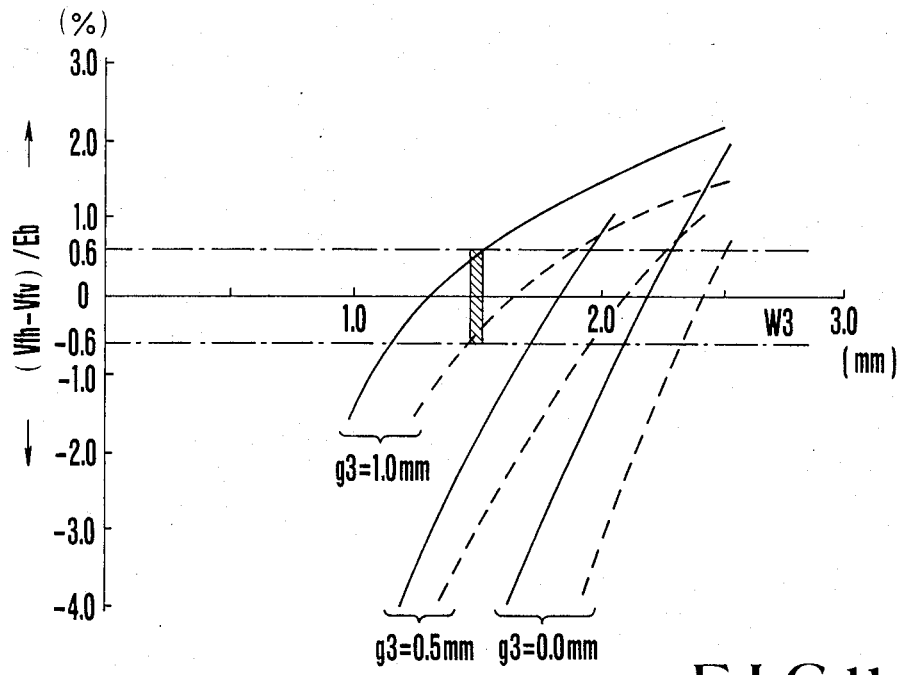
FIG. 11 is a graph showing the relation between normalized differential focusing voltage and the width w of a corrective electrode as a function of the distance g between a bridge portion and the corrective plate electrode in order to show the region in which the beam spot becomes circular.

FIG. 11 shows how the width w3 can be determined with respect to various values of the distance g3 so as to obtain a circular electron beam spot on a phosphor screen under a condition that g4 is zero and w4 is 5.0 mm, and plottings therein result from calculation of the electron beam locus. In FIG. 11, ordinate represents the difference between horizontal focusing voltage $V_{fh}$ which is the value for obtaining the minimum width of a beam spot on a phosphor screen and vertical focusing voltage $V_{fv}$ which is the value for obtaining the minimum height of a beam spot on the phosphor screen, that is, $V_{fh}-V_{fv}$, which is normalized by anode voltage $E_b$ applied to the fourth grid electrode $\mathbf{10}_{G4}$.

In FIG. 11, the relation between the normalized difference $(V_{fh}-V_{fv})/E_b$ and the width w3 is graphically depicted, with parameters of g3, by solid curves for the center beam which passes through the center electron gun and by dotted curves for the side beams which pass through the two side electron guns. When $V_{fh}$ equals $V_{fv}$, the horizontal lens strength coincides with the vertical lens strength and astigmatic aberration can be eliminated to produce circular beam spot on a phosphor screen. If $V_{fh}$ is unequal to $V_{fv}$, astigmatic aberration takes place and as a result, the electron beam spot becomes non-circular. Under a condition that the focusing voltage is adjusted to a sufficiently high value to suppress the generation of a low luminous portion around the electron beam spot on the phosphor screen, called halo, the electron beam spot becomes longitudinally elliptical when $V_{fh}$ is larger than $V_{fv}$ and laterally elliptical when $V_{fh}$ is smaller than $V_{fv}$.

As will be seen from FIG. 11, the condition for making the center beam circular does not coincide with that for making the side beam circular. However, roundness required for the electron beam spot generally has a tolerance of ±5% which corresponds to a range of ±0.6% in terms of $(V_{fh}-V_{fv})/E_b$ as evidenced by experiments. This range is illustrated by chained lines in FIG. 11. Accordingly, the allowable range of w3 is so determined that the normalized difference $(V_{fh}-V_{fv})/E_b$ for both the center and side beams falls within the range of ±0.6%.

Thus, it will also be seen from FIG. 11 that for the g3 being 1.00 mm, both the center and side beams are satisfied with the allowable range of ±0.6% within a hatched region of 1.4 mm $\leqq$ w3 $\leqq$ 1.6 mm. For the g3 being 0.5 mm, however, the allowable range of w3 does not exist. Calculation shows that the allowable range of w3 can exist if g3 > 0.7 mm. The value, 0.7 mm, thus is a lower limit of g3 under the condition that g4 is zero and w4 is 5.0 mm. If the width w4 is varied to a larger value, the lower limit of g3 will not however change with the prolongation of the width w4 since 5.0 mm for the width w4 is sufficiently large and characteristics remain substantially unchanged with the prolongation. Conversely, if the width w4 is varied to a smaller value, the lower limit of g3 will increase. To sum up, the aforementioned lower limit for g3 holds irrespective of the values of w4 when g4 is zero. Similarly, the lower limit of g3 for various values of g4 may be obtained by determining a value of the lower limit when the width w4 is sufficiently large.

Conversely, the lower limit of g4 for various values of g3 may be obtained by calculation under a condition that the width w3 is sufficiently large.

Figure 12:
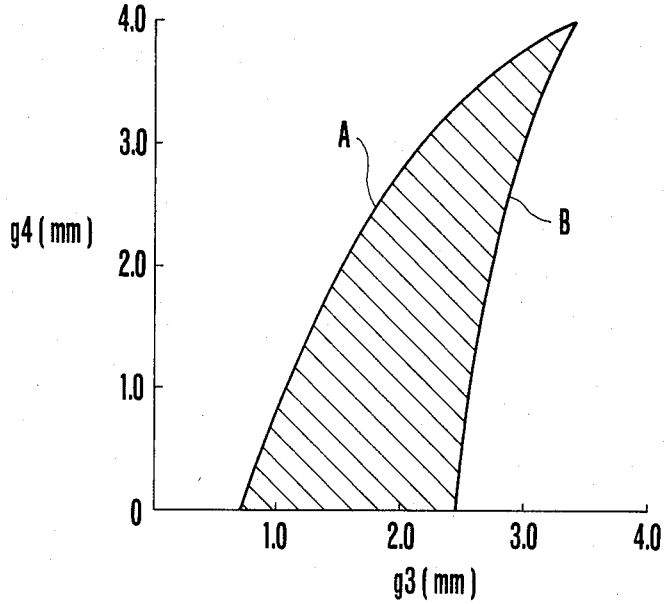
FIG. 12 is a graph showing the relation between the distances for the third and fourth grid electordes according to the present invention.

In the manner descibed above, the relation between the lower limit of g3 and the lower limit of g4 is obtained as shown in FIG. 12 where curve A represents the lower limit of g3 and curve B that of g4. When g3 and g4 fall within a hatched region bounded by the curves A and B, both the center and side beams can simultaneously be made satisfactorily circular by determining the values of w3 and w4 suitably.

It should be understood from FIG. 12 that the conditions 0.7 mm$<$g3$<$3.2 mm and 0.0 mm$<$g4$<$4.0 mm need to be satisfied.

In summary, in accordance with an electron gun for a color picture tube according to the present invention, even if the neck diameter is relatively small and the electron gun is of in-line type, the diameter of each main lens may be made relatively large, and the shape of the beam spot formed thereby may be made circular, thereby significantly improving resolution.

What is claimed is:

1. In an electron gun for a color picture tube comprising opposing cup-shaped electrodes each having a plurality of openings laterally aligned in a row, said electrodes being combined such that said openings face each other to form electron lenses, the improvement wherein, in at least one of said electrodes, said openings are formed in a flat bottom wall of said electrode, a bridge portion between adjacent openings has a width 0.5 to 1.5 times a thickness of said bottom wall, and corrective plate electrodes are arranged to oppose said bridge portions with a predetermined distance therefrom inside said electrode.

2. An electron gun according to claim 1, wherein the distance between said bridge portion and said corrective electrode associated therewith is set to reduce spherical aberration of said electron lens formed.

3. An electron gun for a color picture tube comprising opposing cup-shaped electrodes each having a plurality of openings laterally aligned in a row, said electrodes being combined such that said openings face each other to form electron lenses, wherein said openings are formed in flat bottom walls of said electrodes, a width of a bridge portion between adjacent openings is 0.5 to 1.5 times a thickness of the bottom wall of each electrodes, and corrective plate electrodes are arranged to oppose bridge portions with a predetermined distance therefrom inside said electrode, whereby said electrodes are combined such that spherical aberration of said electron lenses as a whole can be reduced when one of said electrodes is applied with a voltage which is higher than that applied to the other.

* * * * *